US006083349A

United States Patent [19]

Schiel

[11] Patent Number: 6,083,349

[45] Date of Patent: Jul. 4, 2000

[54] MACHINE AND METHOD FOR MANUFACTURING A CREPED FIBROUS PULP WEB, WITH A SHOE PRE-PRESS AND A MAIN SHOE PRESS

[75] Inventor: Christian Schiel, Murnau, Germany

[73] Assignee: Voith Sulzer Papiermaschinen GmbH, Heidenheim, Germany

[21] Appl. No.: 08/997,689

[22] Filed: Dec. 23, 1997

[30] Foreign Application Priority Data

Dec. 23, 1996 [DE] Germany ..... 196 54 197

[51] Int. Cl.[7] ..... D21F 3/04; D21F 11/00

[52] U.S. Cl. ..... 162/206; 162/358.3; 162/359.1; 162/360.2

[58] Field of Search ..... 162/205, 206, 162/359.1, 360.2, 358.3

[56] References Cited

U.S. PATENT DOCUMENTS

| | | | |
|---|---|---|---|
| 4,713,147 | 12/1987 | Saarinen | 162/358.3 |
| 4,931,143 | 6/1990 | Karvinen et al. | 162/360.2 |
| 4,973,384 | 11/1990 | Crouse et al. | 162/359 |
| 5,047,122 | 9/1991 | Crouse et al. | 162/206 |
| 5,167,768 | 12/1992 | Cronin et al. | 162/205 |
| 5,230,776 | 7/1993 | Andersson et al. | 162/359.1 |
| 5,256,257 | 10/1993 | Schiel | 162/360.3 |
| 5,393,384 | 2/1995 | Steiner et al. | 162/358.3 |
| 5,810,974 | 9/1998 | Laapotti | 162/359.1 |
| 5,868,904 | 2/1999 | Laapotti | 162/359.1 |

FOREIGN PATENT DOCUMENTS

| | | |
|---|---|---|
| 4224730 | 9/1993 | Germany . |
| 2199398 | 7/1988 | United Kingdom . |
| 91/00389 | 1/1991 | WIPO . |
| 9100389 | 1/1991 | WIPO . |

*Primary Examiner*—Karen M. Hastings
*Attorney, Agent, or Firm*—Greenblum & Bernstein, P.L.C.

[57] ABSTRACT

A machine for manufacturing a fibrous pulp web, in particular a tissue or hygienic paper web with a main press, including a contact shoe press unit and a drying cylinder, and a shoe pre-press. The main press is so designed that the pressure profile which is built up in its press opening along the length of the opening exhibits increasing pressure, which starts at the beginning of the opening and extends along at least one third, preferably a minimum of one half the length of the opening. The length of the main press is shorter (⅓ to ⅔) than the length of of the pre-press, the linear force of the pre-press is greater than the linear force of the main press, and the maximum pressure of the main press is greater than the maximum pressure of the pre-press.

48 Claims, 4 Drawing Sheets

MACHINE AND METHOD FOR MANUFACTURING A CREPED FIBROUS PULP WEB, WITH A SHOE PRE-PRESS AND A MAIN SHOE PRESS

CROSS-REFERENCE TO RELATED APPLICATION

The present invention claims the priority under 35 U.S.C. § 119 of German Application No. 196 54 197.2 filed Dec. 23, 1996, the disclosure of which is expressly incorporated by reference herein in its entirety.

BACKGROUND INFORMATION

1. Field of the Invention

This invention relates to a machine for manufacturing a fibrous pulp web, in particular a tissue or hygienic paper web, with a main press comprising a clamping unit and a drying cylinder.

2. Discussion of Background Information

DE-A-42 24 730 describes several embodiments of a paper machine for processing a tissue or hygienic paper web. One of these embodiments consists of three press locations, with two pre-pressing units having top rolls and lower shoe press rolls having flexible roll sleeves, as well as a main press with a contact press roll and a drying cylinder. The pre-pressing rolls are located before the main press, in the direction of web travel. The paper web is produced on a roll formed between an upper belt and a drainage sieve. The lower belts, designed as permeable felt belts, are guided together with the paper web and the upper belt through both pre-pressing units.

In another known embodiment, an upper belt receives a paper web and subsequently guides it through a pre-pressing unit between an upper roll, and a lower roll with a lower felt, to a main press between a contact press roll and a drying cylinder. In still another known embodiment, the contact press roll is a shoe press roll.

Except for their use of shoe presses, these embodiments more or less correspond to the former, conventional two-felt belt tissue arrangements. These, however, are no longer used in new hygienic paper machines.

In conventional two-felt machines, the upper felt is very dense and the lower felt is very absorbent. To achieve maximum removal of water by the lower felt, the lower roll is designed as a suction roll.

A problem with such two-felt machines, which has led to their replacement by one-felt machines, is that at increasing run speeds, preliminary drying does not occur quickly enough, even with the use of a suction press. As a result, there is inadequate discharge of water, and the web is crushed in the pre-pressing unit.

Nevertheless, the use of a shoe press for the pre-pressing unit is fundamentally advantageous. The specific embodiments shown in DE-A42 24 730, however, have the disadvantage that, among other things, the respective shoe press rolls are arranged in the lower position, where a very wet paper web, for example having a dry content of approximately 6% to 8%, may come from the sheet-formation screen.

Due to the limited depths of the blind holes or grooves on the upper surface of the press sleeve, which result from manufacturing design limitations, the press sleeve cannot absorb during operation all of the accumulated water. This may be the reason that in most of the specific embodiments described in DE-A42 24 730, the main press is arranged with two pre-pressing units, and in one case, a suction press roll is provided as well. Furthermore, in most of the known embodiments, an upper belt is employed which is water impermeable or waterproof.

Especially when compared to a one-felt machine, known embodiments of two-felt machines take up a relatively large amount of space, particularly where two pre-pressing units and a main press are provided, which don't remove any water on the crape cylinder.

SUMMARY OF THE INVENTION

The present invention provides a machine for manufacturing a fibrous web in which these disadvantages are eliminated, where the resulting press impulse, defined by the sum of the linear forces applied to the web divided by the web's running speed, yields high quality paper manufactured with high productivity and low operating costs, and where the use of suction press rolls is unnecessary.

According to the present invention, a machine for manufacturing a fibrous pulp web is provided where the contact press unit of a main press and/or a pressing unit is designed as a shoe press, and where the pressure profile created in its press opening, along the length of the opening (in the direction of web travel) displays progressively increasing pressure, starting at the mouth of the opening and extending along at least one-third, and preferably one-half, the length of the opening. This first shoe press, observed in the direction of web travel, is associated with a pre-pressing unit (located before the first shoe press) which also forms a shoe press having a press opening extending in the web run direction.

A unique distribution of pressure is achieved through the specific design of the respective shoe presses, where the design takes in account the radius of the mating roll, the press sleeve thickness and the felt thickness, as well as the dynamic compressibility of the press felts that are used. Since felt compressibility decreases over time, the press shoe design takes this factor into account. The pressure profile values once determined should be accurate for one or two new press felts (designed as upper and lower felts) at the beginning of their operation, for example during the first two to four days of use.

According to another aspect of the invention, however, there is practically no change in the basic characteristic of progressively increasing pressure in the press opening, even after long felt operation life.

According to another aspect of the invention, the shoe contact press unit is preferably designed as a shoe press roll.

According to yet another aspect of the invention, a second shoe press (i.e., a second shoe press in the direction of web travel) is positioned behind the first shoe press. The length of the press opening of the first shoe press is greater than or equal to 100 mm, and the length of the press opening of the second shoe press is about 60 mm to about 130 mm.

If the first press (in the direction of web travel) is the main press, it is preferable to provide a pre-heating or pre-drying unit in front of the main press, in order to pre-dry and/or pre-heat the fibrous pulp web, which markedly improves the drainage of the fibrous pulp web.

According to another aspect of the invention, the pre-heating and/or pre-drying arrangement preferably includes at least one heat radiator and/or at least one steam-blow-box. Alternatively, or in addition, this pre-heating or pre-drying unit also includes at least one suction unit. In turn, the suction unit can be made up of at least one suction box and/or at least one suction roll.

In a press unit created by a main shoe press and the first shoe press of an associated pre-pressing unit, the length of the press opening of the main press, also constructed as a shoe press, lies in the range of approximately one-third to approximately two-thirds the length of the press opening of the pre-pressing unit.

According to another aspect of the invention, the length of the press opening of the pre-pressing unit lies within a range of about 100 mm to about 250 mm, and the length of the press opening of the main press lies within a range of about 50 mm to about 100 mm.

When using a pre-pressing unit, the contact press unit of the main press can be a conventional press roll equipped with blind holes and a soft rubber covering. This covering preferably has a hardness of approximately 25 to 45 "P&J". This unit of measurement refers to ⅛" ball plastomer points, measured with the Pussey and Jones instrument. This type of main press construction has the advantage that it is relatively cost-effective. Its linear force, however, is limited to 90 kN/m. Greater linear forces decrease the longevity of the soft rubber covering of the contact press unit, and therefore are not recommended.

According to the present invention, it is appropriate in certain cases for the contact press unit of the main press to be a shoe press unit, preferably by a shoe press roll. This design has the significant advantage of increased linear force application and an asymmetrical pressure distribution, with a rapid drop-off in pressure at the end of the press opening (in relation to the direction of web travel). This results in considerably higher final dry content. Both presses can be adjusted as required to cover a wide range of linear forces. For example, the linear force of one or both of the presses can be decreased, at the expense of production capacity, in order to increase the softness of the product. On the other hand, to achieve maximum production capacity when processing mass products, the linear forces can be increased. Additionally, the old felts, which are already compressed, can be used until the next planned machine stoppage, if the linear force is decreased somewhat.

If the contact press unit of the main press is formed as a shoe press unit, preferably a shoe press roll, then it is preferable for the maximum linear force, which is generated in the press opening of the main press, to be less than 250 kN/m, and for the increasing pressure gradient, which is present at the beginning of the opening, to be less than 50 kPa/mm.

It is preferred if the increasing pressure gradient in the first shoe press, in the area of the opening, be less than or equal to 30 kPa/mm. In this example, the first shoe press is equipped with new felts.

According to another aspect of the invention, the average gradient of decreasing pressure at the end of the press opening should preferably be steep, so that no appreciable re-moistening of the fibrous pulp web occurs, due to felt separation. Hence, the press opening of the shoe press has been designed so that the middle gradient of the pressure decrease at the end of the opening lies within the range of about 400 kPa/mm to about 1000 kPa/mm.

Especially when manufacturing soft papers, it is preferable for the linear force in the pre-pressing unit to be greater than in the main press, and for the maximum pressure in the main press to be greater than that in the pre-pressing unit.

According to another aspect of the invention, at least the press opening of the main press zone has a single felt. The felt belt is led through the press opening of the pre-pressing unit, as well as through the press opening of the main press.

In certain instances, it is preferred for the press opening of at least one pre-pressing unit to be double-felted. In such instances, it also is preferred to guide an upper felt belt through the press opening of the pre-pressing unit as well as through the press opening of the main press, and in addition for the lower felt belt to be guided through the press opening of the pre-pressing unit.

The present invention provides a machine for manufacturing a fibrous pulp web that includes a pre-pressing unit and a main press including a contact press unit and a drying cylinder, where at least one of the main press and the pre-pressing unit form a first shoe press with a first press opening having a beginning and a length extending in a web run direction, where the first shoe press imparts increasing pressure to the web in the first press opening to create a pressure profile when observed in the web run direction, and where the pressure profile starts at the beginning of the first shoe press opening and exhibits a progressive increase in pressure that extends at least one-third the length of the first press opening. Further, the progressive increase in pressure may start at the beginning of the first press opening may extend at least one-half the length of the first press opening. The web may be a tissue or a hygienic paper web. Moreover, the main shoe press may include a main shoe press roll. Moreover, a second shoe press forming a second press opening having a beginning and a length, where the second shoe press is positioned ahead of the first shoe press in the web run direction, where the length of the second press opening is at least 100 mm, and where the length of the first press opening lies within the range of approximately 60 mm. to approximately 130 mm.

According to the present invention, the main shoe press may include at least one of a pre-heating unit and a pre-drying unit positioned in front of the main shoe press to process the web. The pre-heating unit may include a heat radiator and/or a steam-blow-box. Further, the pre-drying unit may include a heat radiator and/or a steam-blow-box. A suction unit also may be positioned in front of the main shoe press, and the suction unit may include a suction box and/or a suction roll.

The present invention provides a pre-pressing unit that includes a bottom press roll, a top press roll, and a press shoe, where the pre-pressing unit forms a shoe press with a press opening having a beginning and a length extending in the web run direction, and wherein the length of the main press opening lies within a range of approximately one-third to approximately two-thirds the length of the pre-pressing unit press opening. Moreover, the present invention provides a pre-pressing unit that includes a bottom press roll, a top press roll, and a press shoe, where the pre-pressing unit forms a shoe press with a press opening having a beginning and a length extending in the web run direction, where the length of the pre-pressing unit press opening lies within a range of approximately 100 mm to approximately 250 mm, and where the length of the main press opening lies within the range of approximately 50 mm to approximately 100 mm.

According to the present invention, the contact press unit of the main press may include a conventional press roll having blind holes and a soft rubber covering. In turn, the soft rubber covering may have a hardness within the range of approximately 25 P&J units to approximately 45 P&J units. The contact press unit of the main press may include a shoe press where a maximum linear force of less than 250 kN/m is generated in the main press opening, and where an increasing pressure gradient present in the beginning of the main press opening has a value of less than 50 kPa/mm. The contact press unit may include a shoe press roll. Moreover, the first shoe press may include a new felt belt, where an increasing pressure gradient present in the beginning of the first shoe press opening has a value of less than 30 kPa/mm. Alternatively, the contact press unit of the main press may include a shoe press where the contact press unit forms a contact press opening having an end and a length in the web run direction, and where an average pressure gradient present at the end of the contact press opening has a value within the range of approximately 500 kPa/mm to approximately 1000 kPa/mm. Further, the contact press unit comprises a shoe press roll.

According to the present invention, the pre-pressing unit may include a bottom press roll, a top press roll and a press shoe, where the pre-pressing unit forms a shoe press with a press opening, where a linear force and a maximum pressure are generated in the pre-pressing unit press opening, where a linear force and a maximum pressure are generated in the main press opening, where the linear force in the pre-pressing unit press opening is greater than the linear force in the main press opening, and where the maximum pressure in the main press opening is greater than the maximum pressure in the pre-pressing unit press opening. The main press opening may include a single felt belt. Moreover, the pre-pressing unit may include a bottom press roll, a top press roll, and a press shoe, where the pre-pressing unit forms a shoe press with a press opening having a beginning and a length extending in the web run direction, and where a felt belt is guided through the pre-pressing unit press opening and through the main press opening. This pre-pressing unit press opening may include an upper felt belt and a lower felt belt. Further, the upper felt belt may be guided through the pre-pressing unit press opening and through the main press opening, where the lower felt belt is guided through the pre-pressing unit press opening. The contact press unit may include a contact press roll having a press sleeve with an outer surface, where the outer surface includes recesses to absorb pressed-out water. Further, the pre-pressing unit may include a press roll having a press sleeve with an outer surface, where the outer surface has no recesses to absorb water.

The present invention also provides a process for manufacturing a fibrous pulp web in a device having a pre-pressing unit and a main shoe press including a contact press unit and a drying cylinder, where the process includes: forming a press opening having a beginning and a length extending in a web run direction in the pre-pressing unit and/or the main shoe press; guiding the web through the pre-pressing unit and/or the main shoe press opening; and imparting increasing pressure to the web in the pre-pressing unit and/or the main shoe press opening to create a pressure profile, where the pressure profile starts at the beginning of the pre-pressing unit and/or the main shoe press opening and extends along at least one-third the length of the opening in the web run direction. Alternatively, the pressure profile may extend along at least one-half the length of the pre-pressing unit and/or the main shoe press opening. The web may be a tissue web or a hygienic paper web.

The process may also include providing a second shoe press, forming a second shoe press opening having a beginning and a length extending in the web run direction; and guiding the web through the second shoe press opening, where the second shoe press is positioned behind the pre-pressing unit and/or the main press in the web run direction, where the length of the pre-pressing unit and/or the main press opening is at least 100 mm, and where the length of the second shoe press opening lies within the range of approximately 60 mm. to approximately 130 mm. Moreover, the process may include positioning a pre-heating unit and/or a pre-drying unit in front of the main shoe press to process the web. The pre-heating unit may include a heat radiator and/or a steam-blow-box. Additionally, the pre-drying unit may include a heat radiator and/or a steam-blow-box. Further, a suction unit may be positioned in front of the main shoe press. This suction unit may include a suction box and/or a suction roll.

According to the present invention, the pre-pressing unit may include a bottom press roll, a top press roll, and press shoe, where the pre-pressing unit forms a shoe press with a press opening having a beginning and a length extending in the web run direction, and where the length of the main press opening lies within a range of approximately one-third to approximately two-thirds the length of the pre-pressing unit press opening. Alternatively, the pre-pressing unit may include a bottom press roll, a top press roll, and a press shoe, where the pre-pressing unit forms a shoe press with a press opening having a beginning and a length extending in the web run direction, where the length of the pre-pressing unit press opening lies within a range of approximately 100 mm to approximately 250 mm, and where the length of the main press opening lies within the range of approximately 50 mm to approximately 100 mm. The contact press unit of the main press may be a conventional press roll having blind holes and a soft rubber covering. The soft rubber covering may have a hardness within the range of approximately 25 P&J units to approximately 45 P&J units.

According to the present invention, the process for manufacturing the web may include generating a maximum linear force of less than 250 kN/m in the main press opening, where an increasing pressure gradient present in the beginning of the main press opening has a value of less than 50 kPa/mm and where the contact press unit includes a shoe press. The contact press unit may be a shoe press roll. Moreover, the first shoe press may include a new felt belt, where an increasing pressure gradient present in the beginning of the first shoe press opening has a value of less than 30 kPa/mm. The process may include forming a contact press opening having an end and a length in the web run direction, where an average pressure gradient present at the end of the contact press opening has a value within the range of approximately 500 kPa/mm to approximately 1000 kPa/mm, and where the contact press unit of the main press is a shoe press. Further, the contact press unit may be a shoe press roll.

According to the present invention, where the pre-pressing unit includes a bottom press roll, a top press roll, and a press shoe, the process may involve forming a press opening in the pre-pressing unit having a beginning and a length extending in the web run direction, generating a linear force and a maximum pressure in the pre-pressing unit press opening, and generating a linear force and a maximum pressure in the main press opening, where the linear force in the pre-pressing unit is greater than the linear force in the main shoe press, and where the maximum pressure in the main press opening is greater than the maximum pressure in the pre-pressing unit opening. The main press opening may include a single felt belt.

According to the present invention, where the pre-pressing unit includes a bottom press roll, a top press roll and a press shoe, the process may involve forming a press opening in the pre-pressing unit having a beginning and a length extending in the web run direction, and guiding a felt belt through the pre-pressing unit opening and through the main press opening. Further, the pre-pressing unit opening may include an upper felt belt and a lower felt belt. The process may further involve guiding the upper felt belt through the pre-pressing unit opening and through the main press opening, and guiding the lower felt belt through the pre-pressing unit press opening. The contact press unit may be a contact press roll having a press sleeve with an outer surface, where the outer surface includes recesses to absorb pressed-out water. Further, the pre-pressing unit may include a press roll having a press sleeve with an outer surface, where the outer surface has no recesses to absorb water.

Further, the aforementioned and following characteristic features of the present invention can be used not only in the described combinations, but also in other combinations or alone, without departing from the scope of the invention. Further embodiments and advantages can be seen from the detailed description and the accompanying Figures.

BRIEF DESCRIPTION OF THE DRAWINGS

The present invention is further described in the detailed description which follows, in reference to the noted drawings by way of non-limiting examples of preferred embodiments of the present invention, wherein the same reference numerals represent similar parts throughout the drawings, and wherein.

DETAILED DESCRIPTION OF THE INVENTION

Figure 1:
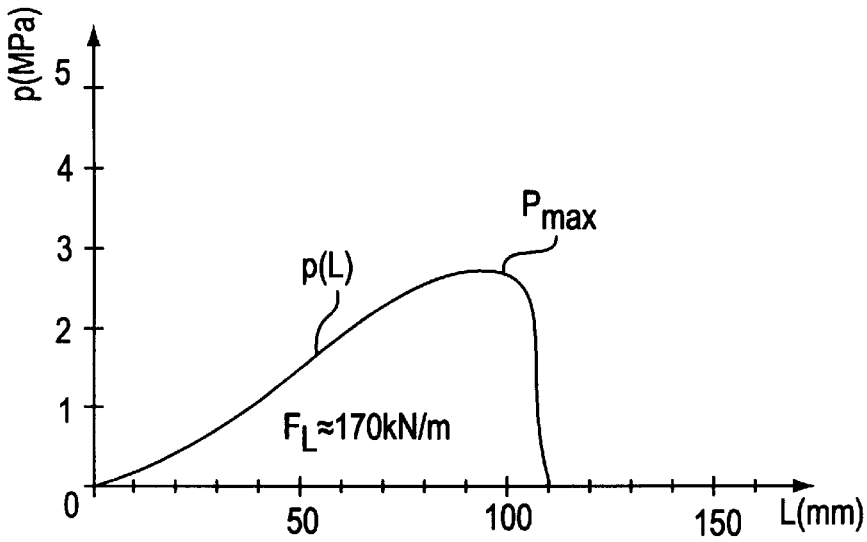
FIG. 1 illustrates the pressure profile of a one-felt tissue machine with a new felt.

The particulars shown herein are by way of example and for purposes of illustrative discussion of the preferred embodiments of the present invention only and are presented in the cause of providing what is believed to be the most useful and readily understood description of the principles and conceptual aspects of the invention. In this regard, no attempt is made to show structural details of the invention in more detail than is necessary for the fundamental understanding of the invention, the description taken with the drawing making apparent to those skilled in the art how the several forms of the invention may be embodied in practice.

According to the present invention, FIG. 1 illustrates the pressure profile p(L) in a press opening of a one-felt tissue machine using a new felt belt. The press opening is created between a drying cylinder and a contact press roll.

As shown in FIG. 1, the amount of applied pressure p (shown in MPa) lies along the length L (shown in mm). The linear force generated in the press opening amounts to approximately 170 kN/m.

The following parameters correspond to the press opening in this example:

Diameter of the new, cold drying cylinder=3,658 mm

Diameter of the drying cylinder in production=3,665 mm

Diameter of the old drying cylinder in production=3,635 mm

The felt used was a soft suction press felt with a surface weight per unit area of 1,350 g/m$^2$. The old felt still retained a third of the compressibility of the new felt. The press sleeve was 6.2 mm thick and was designed with blind holes.

According to this example, maximum pressure $p_{max}$ amounts to approximately 2.5 MPa.

Figure 2:
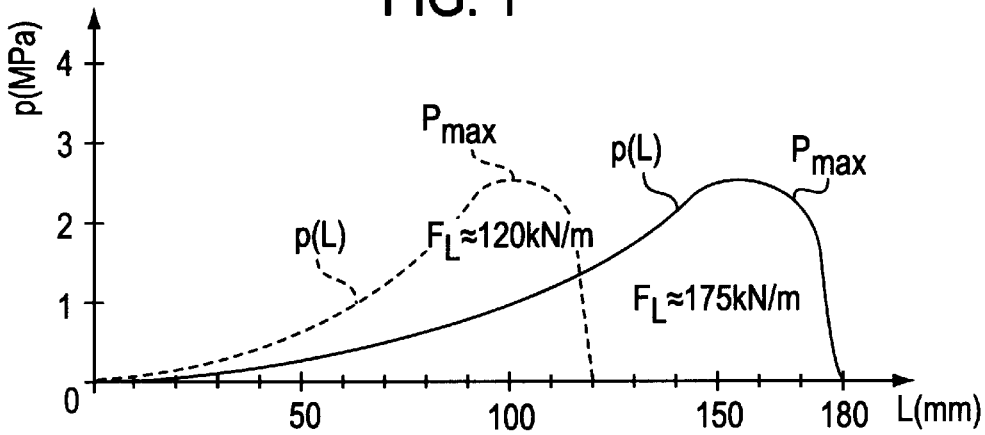
FIG. 2 illustrates the pressure profile in the pre-pressing unit of a two-felt tissue machine with new felts.

According to the present invention, FIG. 2 illustrates the pressure profile in the press opening of a pre-pressing unit of a two-felt tissue machine with new felt belts.

As shown in FIG. 2, the amount of applied pressure p (in MPa) lies along the length L (in mm) of the press opening. The linear force $F_L$ generated in the press opening, depicted in the diagram with a solid line curve, amounts to approximately 175 kN/m. In a further embodiment whose results are depicted with a dotted line, this linear force $F_L$ amounts to approximately 120 kN/m. As can be seen in FIG. 2, the opening length in the second embodiment is less than in the first embodiment.

Figure 3:
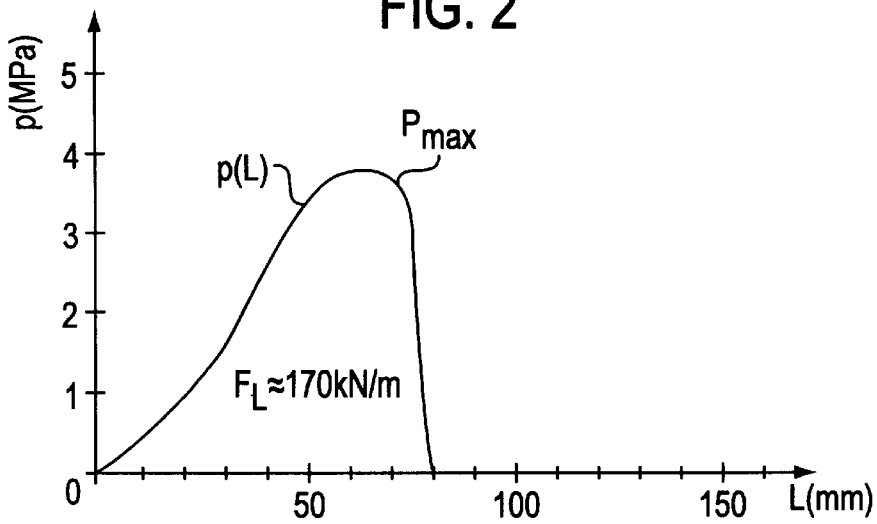
FIG. 3 illustrates the pressure profile in the main press of the two-felt tissue machine with new felts.

According to the present invention, FIG. 3 illustrates the pressure profile in the press opening of the main press of a two-felt tissue machine, where a new upper felt belt that is guided through the main press.

As shown in FIG. 3, the amount of applied pressure p (in MPa) lies along the length L (in mm) of the press opening. The linear force $F_L$ generated in the press opening amounts to approximately 170 kN/m.

As can be seen by comparing the diagrams of FIGS. 2 and 3, the press opening of the main press is shorter than the press opening of the pre-pressing unit. In addition, the maximum pressure in the main press is greater than that in the pre-pressing unit.

By comparing the diagrams of FIGS. 1–3, it also can be seen that the pressure profile of each respective press opening, which is generated along the press opening length, exhibits a progressive increase in pressure, which starts at the beginning of the opening and extends along at least approximately one-third, but preferably a minimum of approximately one-half, the length of the opening.

Figure 4:
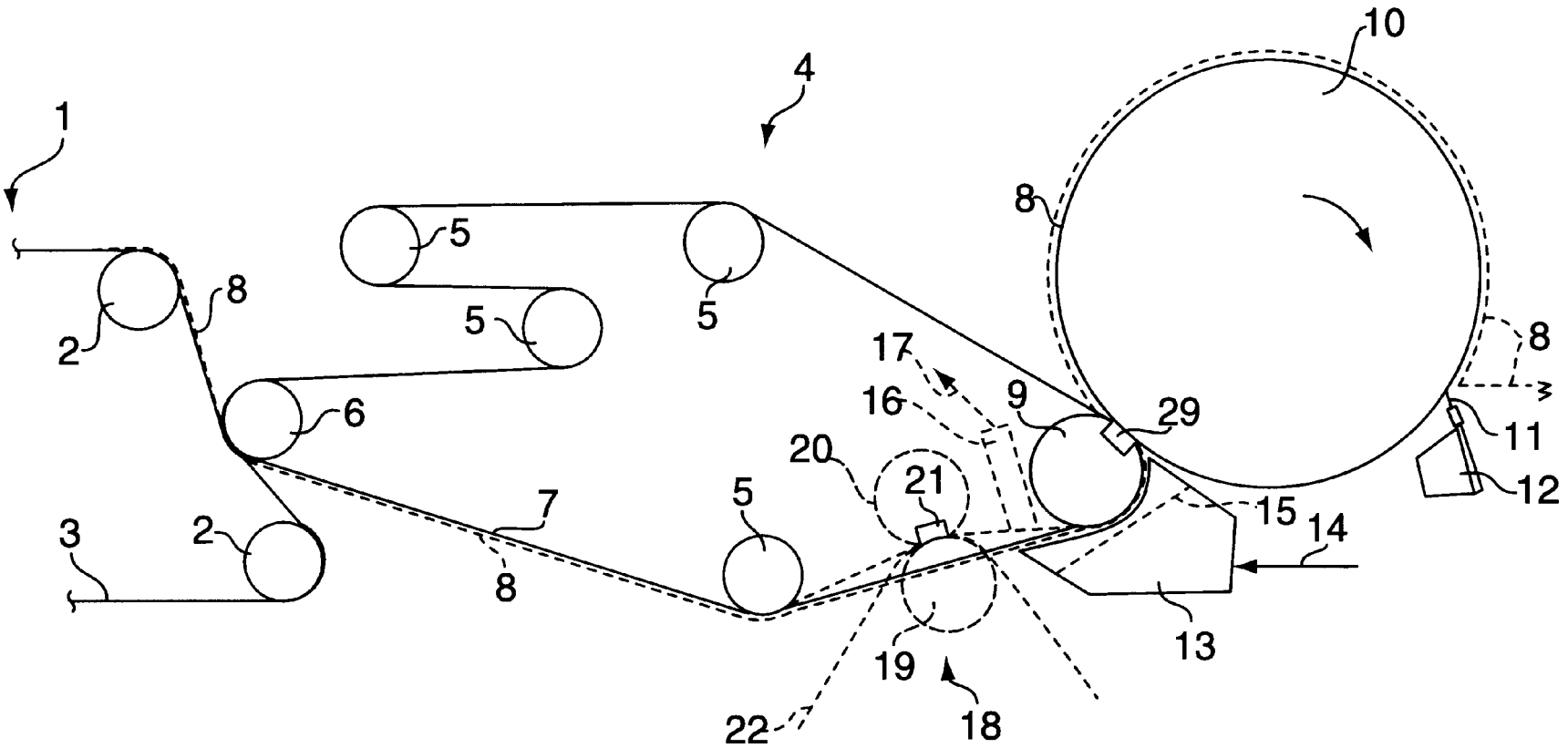
FIG. 4 illustrates a pressing section according to one aspect of the present invention.

In FIG. 4, fibrous web 8 is carried from forming section 1, transferred to the bottom side of top felt 7, and carried past pre-pressing unit 18. Pre-pressing unit 18 may be formed with a bottom press roll 19 and a top press roll 20 with a press shoe 21. Further, additional felt 22 may be guided through pre-pressing unit 18 with felt 7 and web 8. Web 8 and top felt 7 pass through a pressing zone or nip formed where main press roll 9 is pressed against drying cylinder 10. When felt 7 separates from web 8 aer passing through the pressing zone or nip, web 8 follows the surface of drying cylinder 10, until is dried and scraped off drying cylinder 10 by creping doctor 11 supported by doctor beam 12.

Pre-heating unit 13 is positioned under felt 7 and web 8 adjacent to, or preceding, main press roll 9. Pre-heating unit 13 may include a radiator or a steam blow-box that blows steam onto the paper web in order to increase paper temperature in advance of the pressing zone of main shoe press 29. Additionally, the heating of web 8 may be intensified by a suction box 16 that removes air from the paper web 8 in order to facilitate the introduction of steam into the web.

Figure 5:
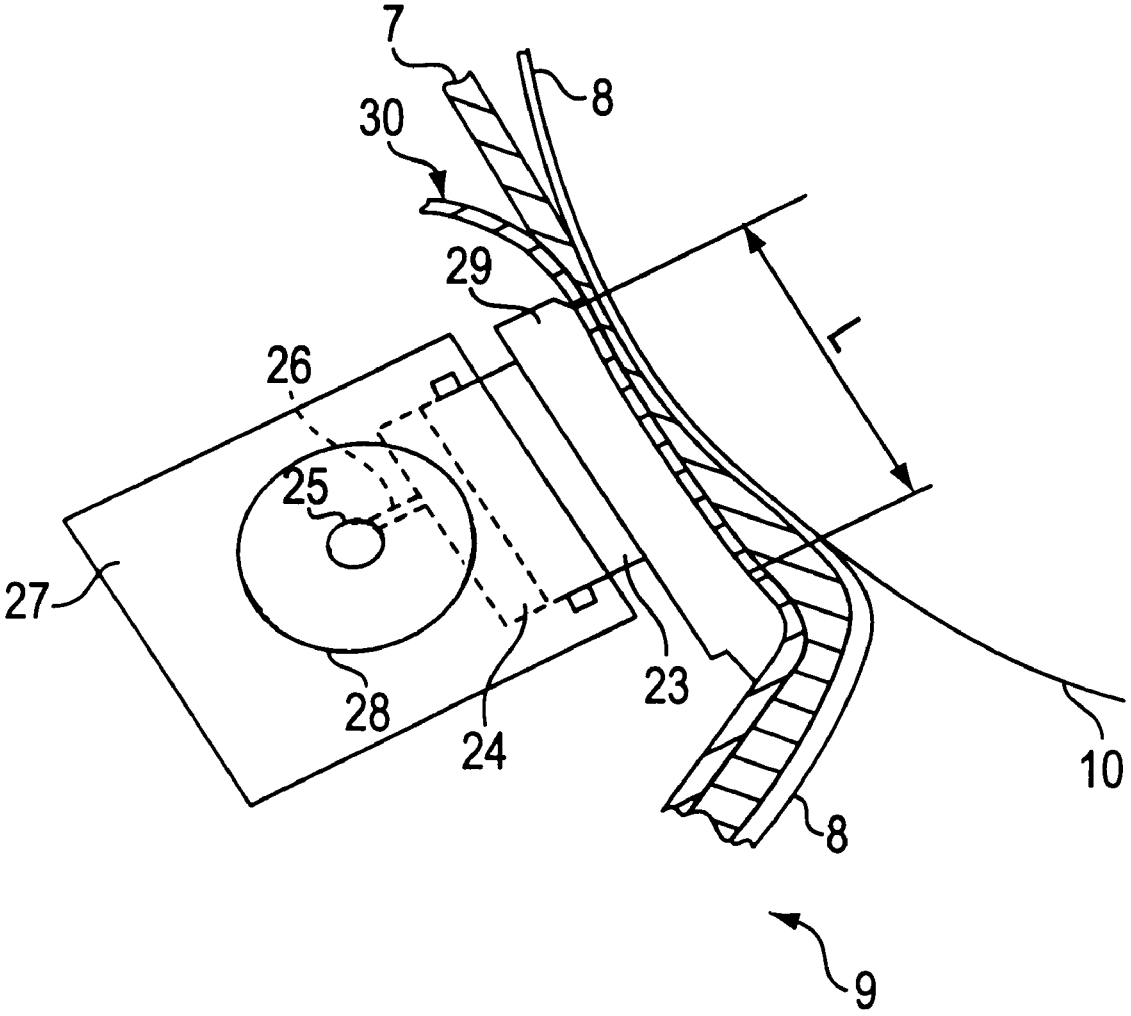
FIG. 5 illustrates a cross-sectional view of a pressing zone according to one aspect of the present invention.

In FIG. 5, the press zone between main press roll 9 and drying cylinder 10 is shown in magnified cross-section. As can be seen in FIG. 5, felt belt 7 is compressed in a pressing zone which has a contact length L and is bounded by press shoe 29, sleeve 30, felt 7, web 8, and dryer cylinder 10. The felt 7 exits pressing zone L and re-expands elastically. Web 8, which also is compressed in the pressing zone L, re-expands but only to a minor extent because water has been removed and its fibers have been flattened by plastic deformation.

The above-noted pressure distribution profiles over the pressing length L are obtained by shaping the surface of shoe 29 in the web travel direction in a manner that accounts for the radius of drying cylinder 10, as well as the elastic and plastic behavior of felt 7, web 8, and, if applicable, the compressibility of main shoe press sleeve 30. Sleeve 30 becomes compressible if the material of the sleeve is soft enough and the groove holes are large enough to allow a substantial decrease in their volume under pressure. By entering the dynamic compressibility of felt 7, web 8 and sleeve 30 into a special computer program, the surface of a shoe press can be shaped to achieve the desired pressure distribution curve through the pressing zone length L.

Figure 6:
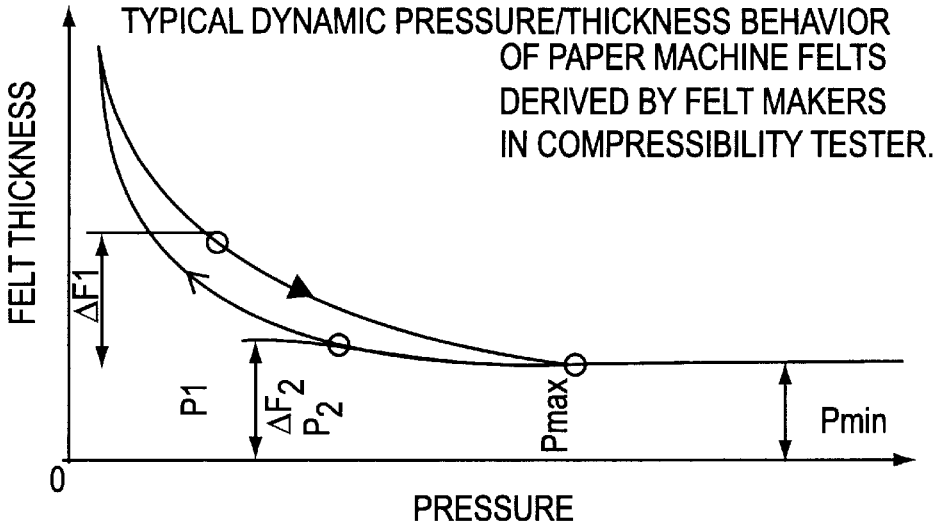
FIG. 6 illustrates the dynamic pressure/thickness behavior of felts determined by compressibility tests.

FIG. 6 illustrates the relationship between dynamic pressure and the thickness of a felt for a web manufacturing machine. Information about the compressibility of the felt is derived from compressibility tests.

Figure 7:
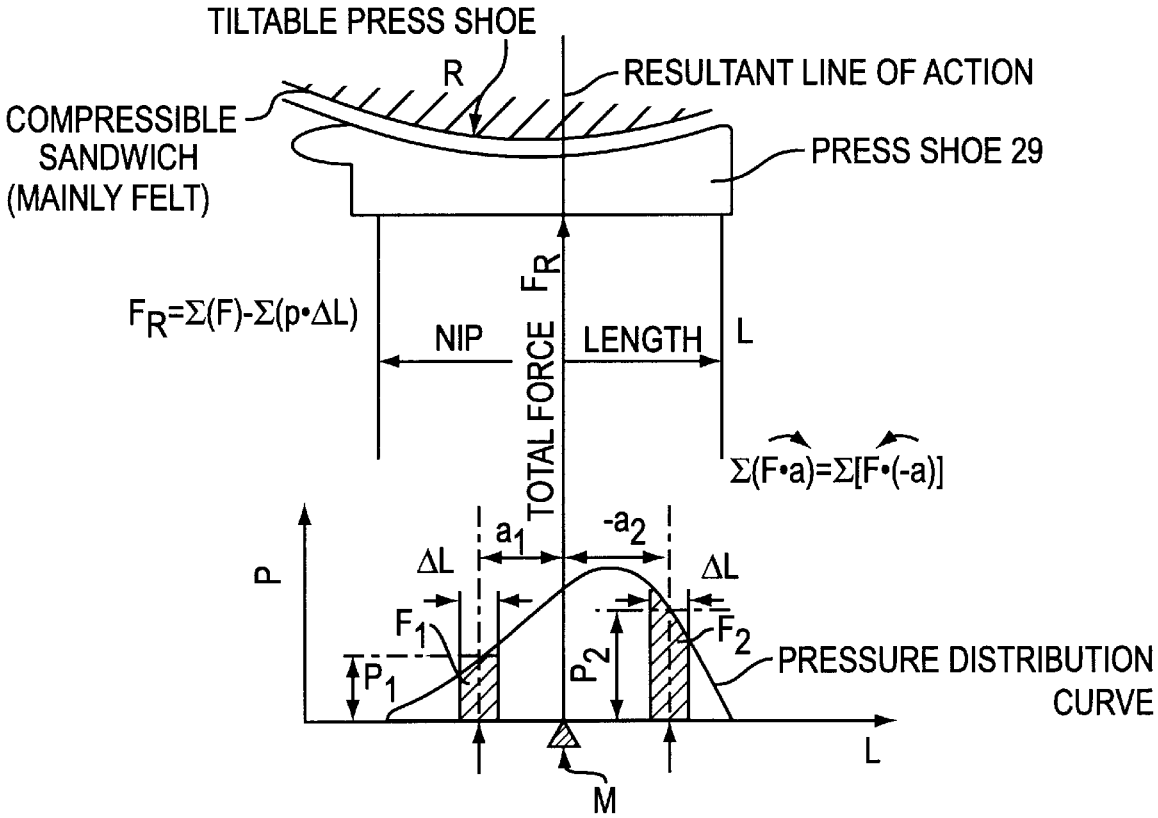
FIG. 7 illustrates schematically the interrelationship between press shoe surface design and a pressure distribution profile in a press shoe opening.

As discussed above, the special computer program may be utilized to determine the relationship between the shape of the press shoe surface and the pressure profile in the press nip. FIG. 7 illustrates this relationship. As shown in FIG. 7, pressing zone L is divided by total force line $F_R$, and press shoe 29 pivots about the associated pivot point M. The pressure distribution curve (or pressure profile) in the nip is divided into sections, and forces to the left of force line $F_R$ (as shown in FIG. 7) are balanced against forces to the right of force line $F_R$. In other words, counterclockwise rotational moments about the pivot point M of the press shoe are balanced against clockwise rotational moments. The section-by-section calculation of moments depends on the shape of the desired distribution curve and the calculation involves an iterative procedure. This iterative calculation of summing up forces section-by-section according to the pressure distribution curve of the press shoe can be performed by hand, or more efficiently using a computer. Based on this calculation, the design of the surface of press shoe 29 can be determined using the press felt compressibility curve shown in FIG. 6. Alternatively, for a given press shoe surface design, and based on the dynamic compressibility of felt 7, web 8 and sleeve 30, a pressure distribution curve can be determined. Again, this iterative calculation is performed more efficiently using the special computer program.

An example of the iterative calculation for determining the shape of the shoe surface is described below:

1. A desired pressing zone length L is chosen
2. A desired nip load is chosen, e.g. 150 kN/m.
3. A desired felt is chosen, whose dynamic thickness/pressure behavior is known (see FIG. 6).
4. A desired maximum pressure $p_{max}$ and a desired pressure distribution curve through the nip is chosen.
5. The curve is sliced up into a sufficiently high number of thin vertical slices (e.g., 20) and the product of the width and average pressure of the slice establishes a vertical force F at a certain distance from a pivot M (see FIG. 7).
6. The sum of all forces F left of the pivot times their distances from the pivot $\Sigma(F \cdot a)$ is calculated, and the sum of all forces F right of the pivot times their distances from the pivot $\Sigma[F \cdot (-a)]$ is calculated.
7. The equilibrium condition that must be met is: $\Sigma(F \cdot a) + \Sigma[F \cdot (-a)] = 0$
8. In a number of iterative steps, the pivot is moved horizontally until the condition is satisfied with sufficient accuracy, e.g. +/−1%. 9. In most cases, compressibility of the web and the press sleeve can be added as a factor to the compressibility of the felt.

E.g. total compressibility=felt compressibility×1.1

10. The minimum felt thickness at the point of maximum pressure on the curve is the basis of establishing the shape of the shoe surface over the length L of the nip.
11. The changes of gap width can be taken from the thickness/pressure diagram of the felt (see FIG. 6 $\Delta f_1$ and $\Delta f_2$).
12. With the gap width known and multiplied by the correction factor of item 9, and the radius of the opposing roll+sleeve thickness+felt thickness $f_{min}$ as a basic radius known, the curvature of the press shoe surface is determined and can be machined.

Alternatively, as noted above, for a given press shoe surface design, based on the dynamic compressibility of felt 7, web 8 and sleeve 30, a pressure distribution curve can be determined.

It is noted that the foregoing examples have been provided merely for the purpose of explanation and are in no way to be construed as limiting of the present invention. While the invention has been described with reference to a preferred embodiment, it is understood that the words which have been used herein are words of description and illustration, rather than words of limitation. Changes may be made, within the purview of the appended claims, as presently stated and as amended, without departing from the scope and spirit of the invention in its aspects. Although the invention has been described herein with reference to particular materials and embodiments, the invention is not intended to be limited to the particulars disclosed herein; rather, the invention extends to a functionally equivalent structures, methods and uses, such as are within the scope of the appended claims.

Reference List $F_L$ = linear force
L = length of the press opening
p(L) = pressure distribution curve or pressure profile
$p_{max}$ = maximum pressure
M = pivot point
1 = forming section
2 = wire roll
3 = forming wire
4 = pressing section
5 = felt roll
6 = pickup roll
7 = top felt
8 = fibrous web
9 = main press roll
10 = drying cylinder
11 = creping doctor
12 = doctor beam
13 = preheating unit
14 = steam supply
15 = perforated plate/heat radiators
16 = suction box
17 = vacuum line to vacuum pump (not shown)
18 = pre-pressing unit
19 = bottom press roll
20 = top press roll
21 = press shoe
22 = bottom felt
23 = row of pistons
24 = row of hydraulic cylinders
25 = pressure line
26 = lines to cylinders
27 = cross member -continued

| Reference List |
| --- |
| 28 = end journal of cross member |
| 29 = press shoe |
| 30 = press sleeve |

What is claimed is:

1. A machine for manufacturing a creped fibrous pulp web, comprising:

a pre-pressing unit;

a main shoe press including a contact press unit and a drying cylinder;

the main press comprising a first shoe press with a first press opening having a beginning and a first length extending in a web run direction, the first press opening adapted to progressively increase a pressure in the first opening over at least a first one-third of the first length;

the pre-pressing unit comprising a second shoe press with a second press opening having a beginning and a second length extending in the web run direction, the second press opening adapted to progressively increase a pressure in the second opening over at least a first one-third of the second length; and a creping doctor positioned in contact with the drying cylinder;

wherein the length of the first press opening is within a range of approximately one-third to approximately two-thirds the length of the second press opening, wherein a linear force in the second press opening is greater than a linear force in the first press opening, and wherein a maximum pressure in the first press opening is greater than the maximum pressure in the second press opening.

2. The machine according to claim 1, wherein the pressure starts at the beginning of the first press opening and progressively increases over at least one-half of the length of the first press opening.

3. The machine according to claim 1, the web comprising a tissue or a hygienic paper web.

4. The machine according to claim 1, the main shoe press comprising a main shoe press roll.

5. The machine according to claim 1, comprising:

a second shoe press forming a second press opening having a beginning and a length, wherein the second shoe press is positioned ahead of the first shoe press in the web run direction, wherein the length of the second press opening is at least 100 mm, and wherein the length of the first press opening lies within the range of approximately 60 mm. to approximately 130 mm.

6. The machine according to claim 1, the main shoe press further comprising:

at least one of a pre-heating unit and a pre-drying unit positioned in front of the main shoe press to process the web.

7. The machine according to claim 6, wherein the pre-heating unit comprises at least one of a heat radiator and a steam-blow-box.

8. The machine according to claim 6, wherein the pre-drying unit comprises at least one of a heat radiator and a steam-blow-box.

9. The machine according to claim 6, further comprising a suction unit.

10. The machine according to claim 9, wherein the suction unit is comprised of at least one of a suction box and a suction roll.

11. The machine according to claim 1, wherein the pre-pressing unit comprises a bottom press roll; a top press roll; and a press shoe.

12. The machine according to claim 1, wherein the pre-pressing unit comprises a bottom press roll; a top press roll; and a press shoe, wherein the length of the pre-pressing unit press opening is within a range of approximately 100 mm to approximately 250 mm, and wherein the length of the main press press opening is within the range of approximately 50 mm to approximately 100 mm.

13. The machine according to claim 1, wherein the contact press unit of the main press comprises a press roll having blind holes and a soft rubber covering.

14. The machine according to claim 13, wherein the soft rubber covering has a hardness within the range of approximately 25 P&J units to approximately 45 P&J units.

15. The machine according to claim 1, wherein the contact press unit of the main press comprises the first shoe press, wherein a maximum linear force of less than 250 kN/m is generated in the main press press opening, and wherein an increasing pressure gradient present in the beginning of the main press press opening has a value of less than 50 kPa/mm.

16. The machine according to claim 15, wherein the contact press unit comprises a shoe press roll.

17. The machine according to claim 1, the first shoe press comprising a new felt belt, wherein an increasing pressure gradient present in the beginning of the first press opening has a value of less than 30 kPa/mm.

18. The machine according to claim 1, wherein the contact press unit of the main press comprises a shoe press, wherein the contact press unit forms a contact press opening having an end and a length in the web run direction, and wherein an average pressure gradient present at the end of the contact press opening has a value within the range of approximately 500 kPa/mm to approximately 1000 kPa/mm.

19. The machine according to claim 18, wherein the contact press unit comprises a shoe press roll.

20. The machine according to claim 1, wherein the main press press opening comprises a single felt belt.

21. The machine according to claim 1, wherein the pre-pressing unit comprises a bottom press roll; a top press roll; and a press shoe, and wherein a felt belt is guided through the pre-pressing unit press opening and through the main press press opening.

22. The machine according to claim 21, wherein the pre-pressing unit press opening comprises an upper felt belt and a lower felt belt.

23. The machine according to claim 22, wherein the upper felt belt is guided through the pre-pressing unit press opening and through the main press press opening, and wherein the lower felt belt is guided through the pre-pressing unit press opening.

24. The machine according to claim 1, the contact press unit comprising a contact press roll having a press sleeve with an outer surface, wherein the outer surface includes recesses to absorb pressed-out water.

25. The machine according to claim 24, the pre-pressing unit comprising a press roll having a press sleeve with an outer surface, wherein the outer surface has no recesses to absorb water.

26. A process for manufacturing a creped fibrous pulp web in a device having a pre-pressing unit and a main shoe press including a contact press unit and a drying cylinder, the main press includes a first shoe press with a first press opening having a beginning and a first length extending in a web run direction, and the pre-pressing unit includes a second shoe press with a second press opening having a beginning and a second length extending in the web run direction, a length of the first press opening is within a range of approximately one-third to approximately two-thirds a length of the second press opening, the process comprising:

guiding the web through the first and second press openings;

imparting increasing pressure to the web in the first press opening to create a pressure profile, wherein a progressively increasing pressure profile starts at the beginning of the first press opening and extends over at least one-third of the length of the first press opening;

imparting increasing pressure to the web in the second press opening to create a pressure profile, wherein a progressively increasing pressure profile starts at the beginning of the second press opening and extends over at least one-third of the length of the second press opening, generating a linear force in each of the first and second press openings, wherein a linear force in the second press opening is greater than a linear force in the first press opening;

generating a maximum pressure in each of the first and second press openings, wherein a maximum pressure in the first press opening is greater than the maximum pressure in the second press opening; and creping the web off of a surface of the drying cylinder.

27. The process according to claim 26, wherein the progressively increasing pressure profile extends over at least one-half of the length of the at least one press opening.

28. The process according to claim 26, wherein the web comprising a tissue web or hygienic paper web.

29. The process according to claim 26, wherein the length of the second press opening is at least 100 mm, and wherein the length of the main press opening lies within the range of approximately 60 mm. to approximately 130 mm.

30. The process according to claim 26, further comprising:

positioning at least one of a pre-heating unit and a pre-drying unit in front of the main shoe press to process the web.

31. The process according to claim 30, the pre-heating unit comprising at least one of a heat radiator and a steam-blow-box.

32. The process according to claim 31, the pre-drying unit comprising at least one of a heat radiator and a steam-blow-box.

33. The process according to claim 30, comprising positioning a suction unit in front of the main shoe press.

34. The process according to claim 33, the suction unit comprising at least one of a suction box and a suction roll.

35. The process according to claim 26, wherein the pre-pressing unit includes a bottom press roll, a top press roll, and a press shoe.

36. The process according to claim 26, wherein the pre-pressing unit includes a bottom press roll, a top press roll, and a press shoe, wherein the length of the pre-pressing unit press opening is within a range of approximately 100 mm to approximately 250 mm, and wherein the length of the main press press opening is within the range of approximately 50 mm to approximately 100 mm.

37. The process according to claim 26, the contact press unit of the main press comprising a press roll having blind holes and a soft rubber covering.

38. The process according to claim 37, the soft rubber covering having a hardness within the range of approximately 25 P&J units to approximately 45 P&J units.

39. The process according to claim 26, comprising:

generating a maximum linear force of less than 250 kN/m in the main press press opening, wherein an increasing pressure gradient present in the beginning of the main press press opening has a value of less than 50 kPa/mm, and wherein the contact press unit includes a shoe press.

40. The process according to claim 39, the contact press unit comprising a shoe press roll.

41. The process according to claim 26, the first shoe press comprising a new felt belt, wherein an increasing pressure gradient present in the beginning of the first shoe press opening has a value of less than 30 kPa/mm.

42. The process according to claim 26, comprising:

forming a contact press opening having an end and a length in the web run direction, wherein a average pressure gradient present at the end of the contact press opening has a value within the range of approximately 500 kPa/mm to approximately 1000 kPa/mm, and wherein the contact press unit of the main press comprises a shoe press.

43. The process according to claim 42, the contact press unit comprising a shoe press roll.

44. The process according to claim 26, wherein the main press press opening comprising a single felt belt.

45. The process according to claim 26, the pre-pressing unit opening comprising an upper felt belt and a lower felt belt.

46. The process according to claim 45, comprising:

guiding the upper felt belt through the pre-pressing unit opening and through the main press press opening; and guiding the lower felt belt through the pre-pressing unit press opening.

47. The process according to claim 26, the contact press unit comprising a contact press roll having a press sleeve with an outer surface, wherein the outer surface includes recesses to absorb pressed-out water.

48. The process according to claim 47, the pre-pressing unit comprising a press roll having a press sleeve with an outer surface, wherein the outer surface has no recesses to absorb water.

* * * * *